US009287617B2

(12) United States Patent
Kokkinos

(10) Patent No.: US 9,287,617 B2
(45) Date of Patent: Mar. 15, 2016

(54) WIDEBAND ANTENNA

(71) Applicant: Alcatel Lucent, Boulogne Billancourt (FR)

(72) Inventor: Titos Kokkinos, Stuttgart (DE)

(73) Assignee: Alcatel Lucent, Boulogne-Billancourt (FR)

( * ) Notice: Subject to any disclaimer, the term of this patent is extended or adjusted under 35 U.S.C. 154(b) by 117 days.

(21) Appl. No.: 14/358,549

(22) PCT Filed: Nov. 5, 2012

(86) PCT No.: PCT/EP2012/004607
§ 371 (c)(1),
(2) Date: May 15, 2014

(87) PCT Pub. No.: WO2013/072023
PCT Pub. Date: May 23, 2013

(65) Prior Publication Data

US 2014/0327591 A1 Nov. 6, 2014

(30) Foreign Application Priority Data

Nov. 15, 2011 (EP) ..... 11360051

(51) Int. Cl.
*H01Q 1/52* (2006.01)
*H01Q 9/28* (2006.01)
(Continued)

(52) U.S. Cl.
CPC ..... *H01Q 1/523* (2013.01); *H01Q 9/28* (2013.01); *H01Q 21/0087* (2013.01); *H01Q 21/26* (2013.01); *Y10T 29/49016* (2015.01)

(58) Field of Classification Search
CPC ..... H01Q 1/523; H01Q 9/28; H01Q 21/0087; H01Q 21/26
USPC ..... 343/797, 798
See application file for complete search history.

(56) References Cited

U.S. PATENT DOCUMENTS 2,573,914 A 11/1951 Landon
4,131,896 A 12/1978 Miller
(Continued)

FOREIGN PATENT DOCUMENTS

CN 1624978 6/2005
CN 2911985 6/2007
(Continued)

OTHER PUBLICATIONS

China Search Report dated Jan. 12, 2015.
(Continued)

*Primary Examiner* — Hoang V Nguyen
(74) *Attorney, Agent, or Firm* — Fay Sharpe LLP

(57) ABSTRACT

Wideband antennas, a wideband antenna assembly and a method are disclosed. One wideband antenna comprises at least one dipole arm base (90A) to be received by a ground plane (80) and supporting at least one dipole arm (20) fed by a dipole arm feed (40), said dipole arm base being dimensioned to provide less than a quarter wavelength separation between said ground plane and said dipole arm, said dipole arm base having apertures (100) to provide a quarter wavelength effective electrical length between said ground plane and said dipole arm feed. Through this approach, it can be seen that the height of the antenna can be reduced whilst still maintaining its correct operation by providing slots to increase the effective electrical length.

15 Claims, 6 Drawing Sheets

(51) Int. Cl.
*H01Q 21/26* (2006.01)
*H01Q 21/00* (2006.01)

(56) References Cited

U.S. PATENT DOCUMENTS

| | | | | |
|---|---|---|---|---|
| 2007/0210976 | A1 | 9/2007 | Luk et al. | |
| 2007/0290939 | A1 | 12/2007 | Teshirogi et al. | |
| 2008/0231528 | A1 | 9/2008 | Guixa | |
| 2009/0051614 | A1 | 2/2009 | Wong et al. | |
| 2009/0207092 | A1 | 8/2009 | Nysen et al. | |
| 2010/0007571 | A1 | 1/2010 | Riedel | |
| 2011/0298682 | A1* | 12/2011 | Plet | H01Q 1/246 343/797 |
| 2012/0081259 | A1* | 4/2012 | Regala | H01Q 21/26 343/797 |

FOREIGN PATENT DOCUMENTS

| | | | |
|---|---|---|---|
| CN | 101160692 | | 4/2008 |
| CN | 101626112 | | 1/2010 |
| CN | 201994412 | | 9/2011 |
| DE | 102 59 833 | A1 | 7/2003 |
| DE | 10 2006 039279 | A1 | 2/2008 |
| EP | 1 406 348 | A2 | 4/2004 |
| EP | 1 978 592 | A1 | 10/2008 |
| JP | 2005-203971 | | 7/2005 |
| JP | 2009-118368 | | 5/2009 |
| JP | 2009 200776 | A | 9/2009 |

OTHER PUBLICATIONS

International Search Report for PCT/EP2012/004607 dated Feb. 25, 2013.

* cited by examiner

WIDEBAND ANTENNA

FIELD OF THE INVENTION

The present invention relates to wideband antennas, a wideband antenna assembly and a method.

BACKGROUND

Wideband antennas are known. Typically, such antennas are used in cellular base station antenna panels and are optimized to provide a desired bandwidth and gain. Although these antennas can provide adequate performance and characteristics, they still have shortfalls.

Accordingly, it is desired to provide an improved wideband antenna.

SUMMARY

According to a first aspect, there is provided a wideband antenna, comprising: at least one dipole arm base to be received by a ground plane and supporting at least one dipole arm fed by a dipole arm feed, the dipole arm base being dimensioned to provide less than a quarter wavelength separation between the ground plane and the dipole arm, the dipole arm base having apertures to provide a quarter wavelength effective electrical length between the ground plane and the dipole arm feed.

The first aspect recognises that the physical constraints being placed on wideband antennas are increasing. In particular, it is desired that the space occupied by the wideband antennas is reduced in order to reduce the overall size of antenna arrays for weight, structural loading and optical minimisation reasons. However, the first aspect recognises that the height (or profile) of an antenna is typically dictated by the need to provide an effective electrical length between the antenna dipoles and its ground plane. This has led to the height of the dipole base provided between the dipoles and the ground plane needing to be fixed at a predetermined length in order to achieve the required effective electrical length which prevents the height of the dipole base being reduced. In particular, a quarter-wave height of the antenna is generally required for to provide optimized antenna gain and antenna matching performance. Also, the quarter wavelength referred to generally corresponds to a quarter of the value of the wavelength in the middle of the operating frequency band. Accordingly, a dipole arm base is provided which is dimensioned to provide a separation between the ground plane and the dipole arm of less than a quarter wavelength. In order to compensate for the reduction height of the dipole arm base, apertures are provided which alter the effective electrical length back to a quarter wavelength. Through this approach, it can be seen that the height of the antenna can be reduced whilst still maintaining its correct operation by providing slots to increase the effective electrical length. In particular, the use of slits in the dipole arm base to establish the effective quarter-wave electrical length optimizes matching performance but does not completely restore the antenna gain issue and so the antenna will exhibit a little bit less gain than a full height antenna, but can have a much smaller profile. In one embodiment, the apertures are provided between the ground plane and the dipole arm feed. Accordingly, the apertures may be located between the ground plane and the dipole arm feed to increase the effective electrical length between these two points.

In one embodiment, the apertures are defined by slots extending into the dipole arm base. Slots provide a particularly convenient shape which may easily be incorporated into the dipole arm base during manufacture.

In one embodiment, the wideband antenna comprises an assembly of a plurality of adjacent dipole arm bases, each having the apertures positioned adjacently on an interior of the assembly. Accordingly, a dipole base for the complete antenna may be assembled from individual dipole arm bases, each of which has apertures provided therein. By assembling the dipole base in this way, the manufacture of the dipole base with internal apertures is significantly simplified.

According to a second aspect, there is provided a wideband antenna, comprising: a dipole having a dipole arm coupled with a dipole finger, the dipole finger being orientated in a direction orthogonal to the dipole arm, the dipole arm and dipole finger together providing a quarter wavelength effective electrical length.

The second aspect recognises that a problem with existing antennas is that the physical constraints being placed on wideband antennas are increasing. In particular, it is desired that the space occupied by the wideband antennas is reduced in order to reduce the overall size of antenna arrays for weight, structural loading and optical minimisation reasons. However, the second aspect recognises that the footprint of an antenna is typically dictated by the need to provide an effective electrical length of the dipoles. In particular, the second aspect recognises that the need to provide dipoles with a predetermined effective electrical length limits the minimum size footprint that the antenna can occupy.

Accordingly, a dipole arm which may have a dipole finger is provided. The dipole finger may be orientated orthogonally with respect to the dipole arm. The effective electrical length of the combined dipole arm and dipole finger may be a quarter wavelength. By providing a dipole finger which extends out of the plane of the dipole arm, the footprint occupied by the wideband antenna may be reduced. Even with the reduction in the size of the footprint, the resonance characteristics of the dipole may be maintained since the dipole arm and the dipole finger still provide the required effective electrical length.

In one embodiment, the dipole arm extends parallel to a ground plane and the dipole finger is orientated to extend towards the ground plane. Hence, the dipole finger may be orientated in a direction other than being parallel to the dipole arm or the ground plane. It will be appreciated that the greater the degree of orthogonality, the greater the degree of footprint reduction can be achieved.

In one embodiment, the dipole arm comprises a conductive flat plate and the dipole finger comprises an elongate conductive rod coupled towards an edge of the conductive flat plate. Accordingly, the dipole finger need not be a plate and may be located towards one end of the dipole arm. It will be appreciated that the reduction in the footprint is maximised by locating the dipole finger at the outer extremity of the dipole arm.

Embodiments recognise that a problem with the arrangements mentioned above is that the radiation resistance of the wideband antennas may be affected.

In one embodiment, the wideband antenna comprises an assembly of an adjacent plurality of the dipole arm bases having a conductive plate positioned parallel to and in a near-field generated by each dipole arm. Accordingly, a conductive plate may be provided which may be located in a near-field generated by each dipole arm. Such a conductive plate can be used to restore the radiation resistance of the antenna to satisfactory levels.

In one embodiment, the conductive plate is symmetric. Providing a symmetric plate ensures that a uniform change in radiation resistance occurs for each dipole and helps to minimise the introduction of any artefacts.

In one embodiment, the conductive plate defines a central aperture. Providing a central aperture helps to reduce the weight of the antenna.

According to a third aspect, there is provided a wideband antenna assembly, comprising: at least an adjacent pair of wideband antennas spaced apart by a conductive wall located therebetween, the conductive wall comprising a first component upstanding from a ground plane and a second component extending orthogonally from the first component.

The third aspect recognises that a problem with existing antennas is that the physical constraints being placed on wideband antennas are increasing. In particular, it is desired that the space occupied by the wideband antennas is reduced in order to reduce the overall size of antenna arrays for weight, structural loading and optical minimisation reasons. However, the third aspect recognises as antennas are incorporated in close proximity into an antenna array, coupling between adjacent antennas may occur.

Accordingly, a conductive wall is provided between adjacent pairs of antennas. That is to say that a conductive wall is provided between one antenna and another, adjacent, antenna. The conductive wall may have a first component and a second component. The first component may upstand from a ground plane and the second component may extend orthogonally from the first component. The provision of the second component provides for effective decoupling between closely located antennas with a minimised conductive wall structure. This helps to reduce the coupling that would otherwise occur with a minimal weight structure.

In one embodiment, the second component is orientated parallel with respect to an associated dipole arm and the first component extends towards and is orientated orthogonally with respect to the associated dipole arm.

In one embodiment, the conductive wall extends around each wideband antenna and defines apertures between adjacent dipole arms of each wideband antenna. Providing apertures or gaps in the wall helps to minimise any coupling between adjacent dipoles within an antenna.

It will be appreciated that features of the first, second and third aspects may be combined with each other. In particular, it will be appreciated that the features of the dipole arm base, the features of the conductive plate, the features of the dipole arms and/or the features of the conductive wall may be provided alone or in combination with each other to provide a wideband antenna.

According to a fourth aspect, there is provided a method, comprising: assembling a wideband antenna of the first, second or third aspects on a printed circuit board. Assembling a wideband antenna on a printed circuit board provides for a particularly compact arrangement since any associated electronics may also be located on the printed circuit board. Also, the printed circuit board may be used to simplify assembly since the structure of the antenna may be readily located onto the circuit board.

In one embodiment, the assembling comprises assembling an assembly of an adjacent plurality of the dipole bases, each having the apertures positioned adjacently on an interior of the assembly.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present invention will now be described further, with reference to the accompanying drawings, in which.

DESCRIPTION OF THE EMBODIMENTS

Overview

Figure 1:
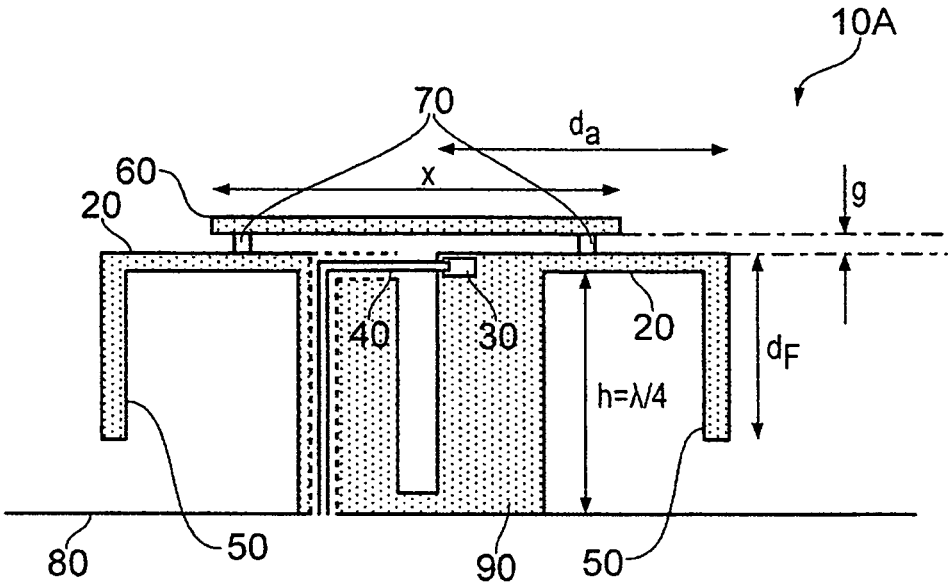
FIG. 1 is a cross section through an antenna according to one embodiment.

Before discussing embodiments in detail, first an overview will be provided. Embodiments relate to a compact, wideband and directive antenna which achieves a desired bandwidth and beamwidth with a reduced size. In conventional cellular base station antenna panels, the volume or size occupied by individual radiators (or antennas) that form the antenna array have hitherto not been considered critical for the overall volume or size of the antenna panel, typically due to the fact that the overall panel volume is mainly determined by the number of radiators used in each antenna panel and also the separation between any adjacent radiators (the array period). Given that antenna panels are usually designed to exhibit optimized performance in terms of bandwidth, the individual resonators are traditionally designed to be large enough to exhibit the required bandwidth and are placed far enough apart from each other so as to achieve a large array factor gain.

These radiators are typically composed of two dipoles placed orthogonally with respect to each other, so as to form an orthogonally dual-linear polarized radiator. These dipoles are fed against a ground plane so as to radiate a directive pattern. Typically, the radiator is square in shape and composed of four conducting (metallic) smaller square patches aligned with respect to each other so as to form a symmetrical 2×2 array. It is possible for defects to be inserted in the dipole arms, such as providing an arm with a hole in it, multiple holes, or arms with a hole of random shape. Each of these square patches comprises one of the two arms of each of the dipoles (two arms per dipole, two dipoles per radiator), while each pair of diagonally placed square patches comprises an entire dipole. In particular, two diametrically opposite patches comprise a first dipole aligned with a −45° axis, while the other two patches comprise a second dipole aligned with the +45° axis.

All of the four dipole arms are attached to a conducting circular base which is utilised to keep all the dipole arms assembled together on the same structure and to fix the separation between the dipole arms and the ground plane against which the dipoles are fed. Although the dipole arms are generally square in shape and the radiator base is typically circular, both the dipole arms and the dipole base can be of any shape (square, circular, triangular, etc.).

In order to feed the dipoles that are formed by the four patches, a differential radio frequency (RF) signal is fed to each of the pairs of the dipole arms in such a way that each dipole arm is connected to one of the two polarities of the RF signal. Typically, a coaxial transmission line is embedded in the dipole base of the radiator, extending from the bottom of the dipole base to the top of the dipole arms. At the top of the dipole arm below which the transmission line is embedded, the shielding of the coaxial cable (ground) is electrically connected with this dipole arm, while the core of the coaxial transmission line (signal) is electrically connected to the second arm of the same dipole that is located diagonally from the first arm of the same dipole. A similar mechanism is employed for the second dipole of the radiator. In this way, the two arms of the same dipole are fed differentially. Off the shelf semi-flexible or semi-rigid coaxial cables properly soldered on the dipole arms can be used. Alternatively, holes may be drilled through the base of the radiator and the conducting dipole base itself may be used as shielding for the coaxial transmission line. A bent wire can be used as the core of the coaxial cable, while a cylindrical dielectric material can be used as the coaxial cable dielectric which maintains a fixed separation between the coaxial core and the coaxial shielding.

The dimensions of the dipole arms determine the operation frequency of the resulting radiator. The self-resonance of each of the dipoles occurs at a frequency related to the diagonal length of each dipole arm. In particular, resonance occurs at the frequency where the diagonal length of the dipole arm corresponds to approximately a quarter wavelength of the resonant frequency. The typical height of such a radiator should also be in the order of a quarter of the wavelength of the operating frequency (typically set to the middle of the operating band). This height is typically required in order to maintain an acceptable level of radiation resistance for the dipole arms and in order to make sure that the lower surface of the dipole base (which is shorted to a ground plane which receives the dipole base) does not affect the dipole reactance at the feeding point to the dipole arms. Through this arrangement, a quarter-wavelength long dipole base shorted at the contact with the ground plane will appear as a perfect open at the feeding point where the dipole arms are fed.

Such radiators are typically used as broadband or wideband radiators which can be used simultaneously over a large number of frequency bands. This performance is attributed both to the shape of the dipole arms and also to the impact of the base of the radiators to their bandwidth matching performance.

Although existing radiators may achieve reasonable performance, they are also fairly large and their performance is significantly decreased when used to form compact arrays having an array spacing of around a one-half wavelength.

Accordingly, an arrangement is provided which produces a more compact antenna. In particular, two dimensions of the dipole have been reduced, which are the antenna footprint (the length of the dipole arms) and the antenna profile (the height of the dipole base), whilst maintaining the performance of the antenna. This is achieved by providing a non-planar conductor which provides an effective electrical length which is longer than the length of the conductor in any particular plane. In particular, the length of the dipole arms is reduced through the provision of dipole fingers coupled with the dipole arms extending in a different plane to the dipole arms which, in combination, provides the required effective electrical length at the designated operating frequency. The height of the dipole base is also reduced through the provision of apertures in the dipole base which compensate for the reduction in height and restore the required effective electrical length between two points of the dipole base. Furthermore, the radiation resistance of the antenna may be improved through the provision of a conductive pad coupled with the near-field generated by the dipole arms. Such a pad improves any reduction in radiation resistance caused by the reduction in size of the antenna. Furthermore, each antenna may be provided with a conductive surrounding wall which enables a compact array of antennas to be provided whilst minimising any cross-coupling.

Reduced Length Dipole Arms

FIG. 1 is a cross section through an antenna, generally 10A, according to one embodiment. This embodiment incorporates reduced length dipole arms which reduce the antenna footprint area (its area when viewed in plan). In particular, each dipole arm 20 has a dipole finger 50 positioned at a corner, away from its respective dipole feed 30, 40. The dipole fingers 50 are shown in this embodiment to be vertically elongated. The dipole fingers have a length $d_f$. The dipole arms have a length between the dipole feed 30, 40 and the dipole finger 50 $d_a$ (also shown in FIG. 4). The size of the dipole arm 20 and the dipole finger 50 is selected such that $d_a+d_f \approx \lambda/4$, where $\lambda$ is the mid-band wavelength. That is to say, the first resonance of the dipoles is achieved approximately when the diagonal length of each dipole arm 20 together with the length of the dipole finger 50 (in this case a vertical pin) sum up to a quarter wavelength.

Using this approach, the exact length of the dipole fingers 50 can be chosen according to the degree of miniaturisation that is required. However, the reduction in the diagonal length $d_a$ of the horizontal dipole arms 20 by extending the length $d_f$ of the vertical dipole fingers 50 causes a reduction in the radiation in the radiation resistance of the dipole, which is mainly provided by the horizontal dipole arms 20. Any reduction in the radiation resistance may be compensated for by the provision of the optional conductive pad 60, as will be described in more detail below.

It has been found that a 20-30% footprint reduction can be achieved without significantly reducing the radiation resistance of the antenna 10A. However, should the radiation resistance need to be increased, then an optional conductive pad 60 may be provided which is spaced away from the dipole arms 20 and positioned within the near-field at a distance g by spacers 70, as will be described in more detail below.

As can be seen in FIG. 1, the dipole arms 20 are supported by a diploe base 90, which is received by a ground plane 80. The dipole base 90 receives a coaxial cable over which a differential RF signal is transmitted. The coaxial cable couples with dipole feeds 30, 40 which causes resonance of the associated dipoles. The antenna 10A may be assembled from multiple components and mounted on a printed circuit board (PCB) as described in more detail below.

It will be appreciated that, as mentioned above, the shape of the dipole arms 20 may be other than a square pad. Also, although placing the dipole fingers 50 on the dipole arms 20 at the furthermost point from the dipole feed 30, 40 provides for maximum footprint reduction, it will be appreciated that the dipole fingers 50 may be located elsewhere. Furthermore, although placing the dipole fingers 50 at an angle of 90° to the dipole arms 20 provides for maximum footprint reduction, the dipole fingers 50 may extend at other angles. In addition, although in this example the dipole fingers 50 are elongate square pins, it will be appreciated that the dipole fingers 50 may be of a different shape. Furthermore, it will be appreciated that the combined length of the dipole arms 20 and dipole fingers 50 of one orientation dipole may differ to those of a different orientation dipole. It will also be appreciated that the antenna 10A may be utilised in combination with the wall structure mentioned below.

Modified Dipole Base

Figure 2:
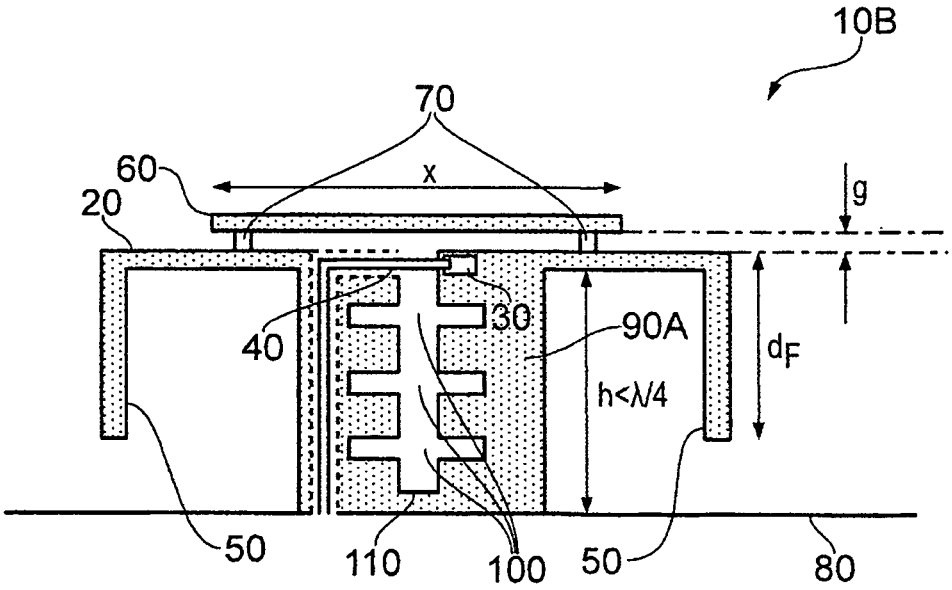
FIG. 2 is a cross section through an antenna according to one embodiment.

FIG. 2 illustrates an antenna, generally 10B, according to one embodiment. This antenna 10B includes a modified dipole base 90A which enables the height h of the antenna 10B to be reduced. In particular, the modified dipole base 90A enables the height h of the antenna 10A to be reduced to below one quarter wavelength.

Such a reduction in height decreases the separation between the dipole arms 20 and the ground plane 80 which may further reduce the radiation resistance. Also, reducing the height h of the dipole base 90A means that the feeding points 30, 40 for the dipoles get electrically closer to the ground plane 80. As a result, the reactance seen by the dipole feeding points 30, 40 is altered. Any reduction in the radiation resistance may be compensated for by the provision of the optional conductive pad 60, as will be described in more detail below.

In order to restore the effective electrical length between the ground plane 80 and the dipole feeding points 30, 40, back to a quarter wavelength a series of apertures 100 is provided which effectively lengthen the overall current path between a feeding point 110 of the dipole base 90A and the feeding points 30, 40 in order to maintain an open circuit at the feeding points 30, 40. In other words, the provision of the apertures 100 restores the effective electrical length between the feeding point 110 and the feeding points 30 or 40 to one quarter wavelength.

Although in this embodiment the apertures 100 are horizontal slots, it will be appreciated that the apertures 100 may be of any suitable number, shape or configuration in order to provide the desired electrical length. However, as will be explained in more detail below, the provision of horizontal slots makes the manufacture of individual dipoles much easier to achieve. The antenna 10B may be assembled from multiple components and mounted on a printed circuit board (PCB) as described in more detail below.

Although the antenna 10B includes the dipole fingers 50, it will be appreciated that these may be omitted and that the antenna 10B may be utilised in combination with the wall structure mentioned below.

Conductive Pad

Figure 3:
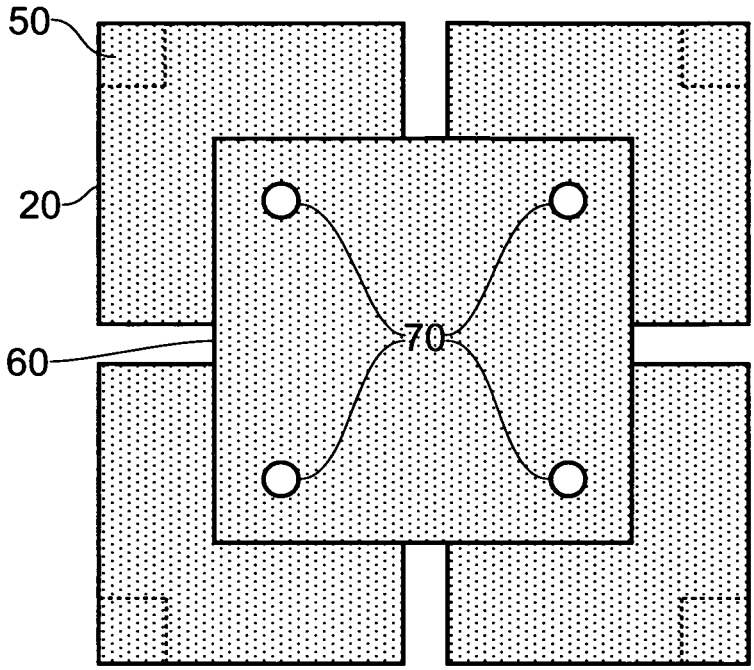
FIG. 3 illustrates in more detail the arrangement of the conductive pad shown in FIGS. 1 and 2.

FIG. 3 illustrates in more detail the arrangement of the conductive pad 60 shown in FIGS. 1 and 2. As mentioned above, any reduction in the radiation resistance of the antenna may be compensated for through the provision of the conductive pad 60. In particular, a horizontal metallic conductive pad 60 is provided in close proximity to the dipole arms 20, but not in electrical contact with them. The conductive pad 60 (which should typically be of sub-wavelength dimensions) provides an effective means of controlling the overall radiation resistance. Such control is achieved by setting its exact dimension X and also its distance g from the dipole arms 20. In particular, the conductive plate 60 should be in close proximity to the dipole arms such that the dimension g is much less than a quarter wavelength to ensure capacitive coupling to the near-field of the dipole arms 20. In this example, dielectric (for example, nylon) spacers 70 are used to maintain the required separation between the conductive pad 60 and the dipole arms 20 and to mechanically support the conductive pad 60.

Although in this example the conductive pad is square, its shape may vary providing that it is symmetrical with respect to the two main axes of the dipoles so as to equally couple both of them and not to worsen the cross-polarization (coupling) performance between them.

Figure 4:
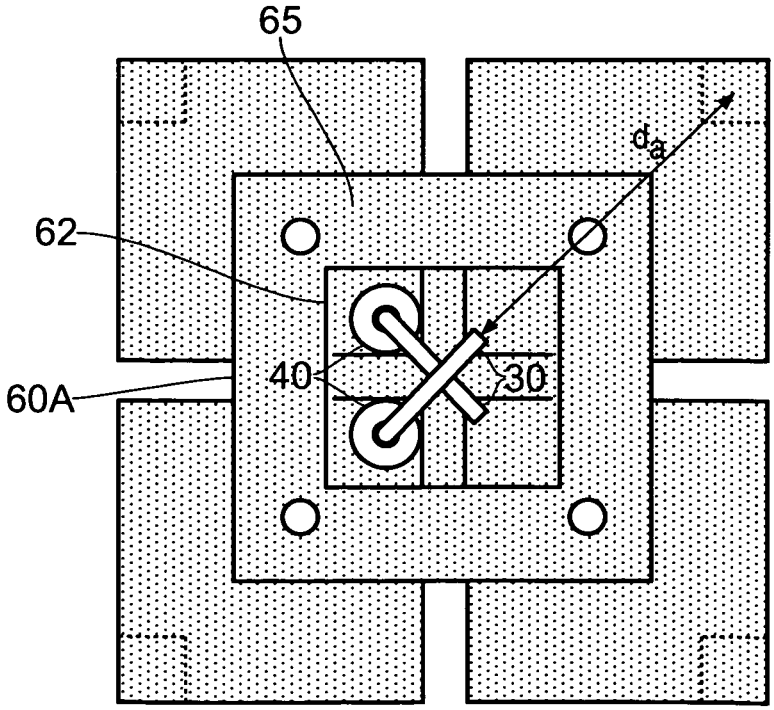
FIG. 4 shows another conductive pad.

FIG. 4 shows another possible shape of a conductive (loading) pad 60A. In this arrangement, the conductive pad 60A has an aperture 62 at its centre. This is possible because most of the current flowing in the conductive pad 60A occurs at its outermost periphery 65, with little current flowing at its centre. This type of conductive pad 60A works well to adjust the radiation resistance, is lighter because it is composed of less material and also reduces any coupling with the feeding wires of the dipoles (whose impedances tend to be very sensitive to their surrounding environment).

Antenna Assembly

Figure 5A:
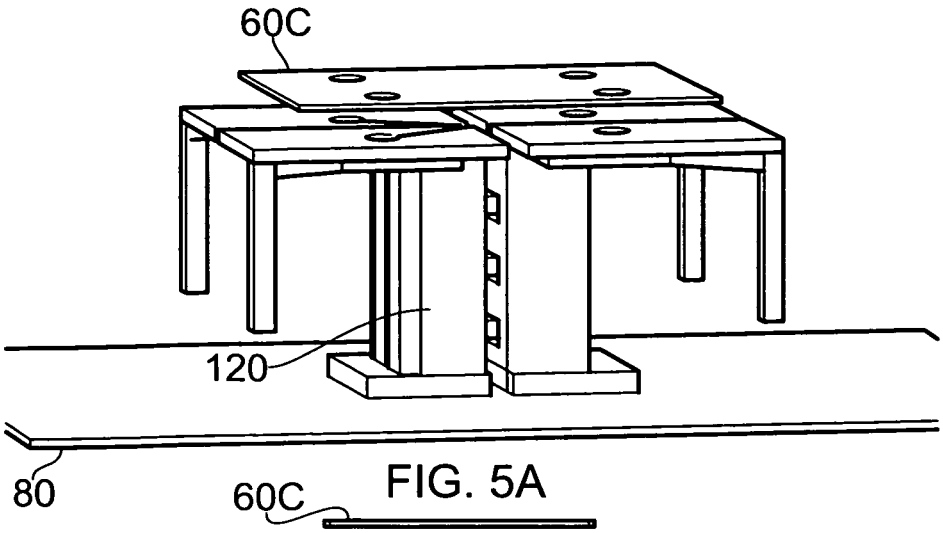
FIGS. 5A to 5C show various views of a model of the antenna of FIG. 2.
Figure 5B:
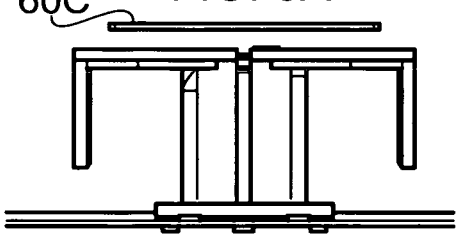
Figure 5C:
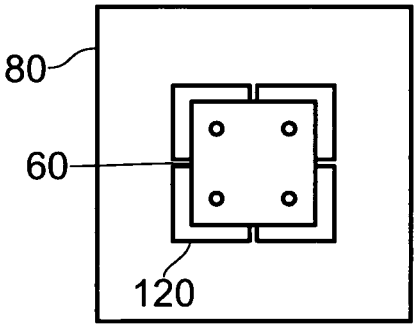

FIGS. 5A to 5C show various views of a model of the antenna of FIG. 2 designed for operation in the AWS-1 band which is an assembly of component parts. As can be seen, each dipole base, dipole arm and dipole finger is moulded as a single structure 120 using an injection moulding or die casting process. The structure 120 may then be coated with a conductive layer if required. The horizontal slots 100 may then be formed during moulding, which significantly simplifies the manufacturing process.

Although the embodiment shown is assembled from four parts, it will be appreciated that the same process could be used to provide a two-part device. In the case of the two-part device, each part comprises two adjacent dipole arms and their dipole fingers (these arms will belong to two different, orthogonally-polarized dipoles) and half of the dipole base. In the case of the four-part device, each structure 120 is composed of a single dipole arm, its dipole finger and a quarter of the dipole base.

In both cases, it is important to ensure that the parts are correctly assembled together to form the entire antenna. To facilitate this, the parts may be mounted on a printed circuit board (PCB) which provides the ground plane 80. The mounting of the parts can be achieved using pins located on the bottom of the dipole base and corresponding apertures on the printed circuit board. In this way, the structures 120 are orientated on the printed circuit board such that the horizontal slots of the parts align and are provided in the interior of the dipole base.

Given that the manufacturing of the antenna in smaller parts and the assembly of them on a printed circuit board afterwards is a potentially costly process, it will be appreciated that use of the horizontal slots may be reserved for only those applications where height reduction is of major importance.

Figure 6:
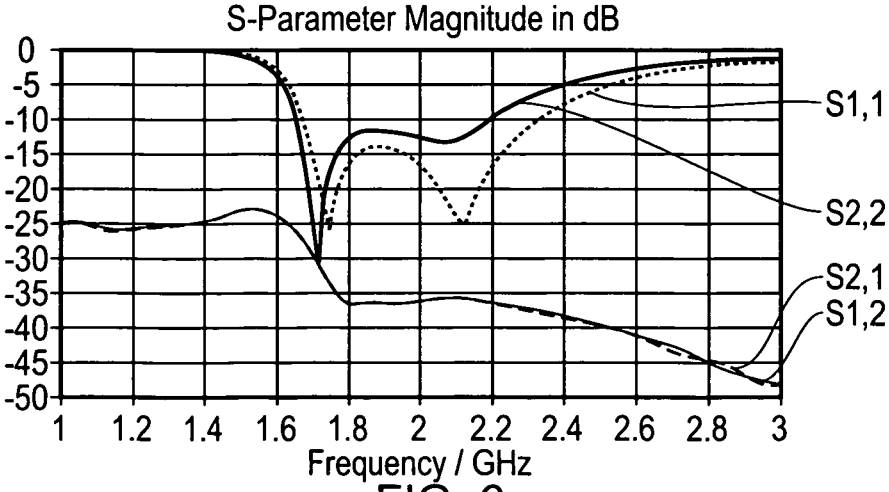
FIG. 6 shows simulated S-parameters of the antenna shown in FIGS. 5A to 5C.

FIG. 6 shows simulated S-parameters of the antenna shown in FIGS. 5A to 5C.

Figure 7:
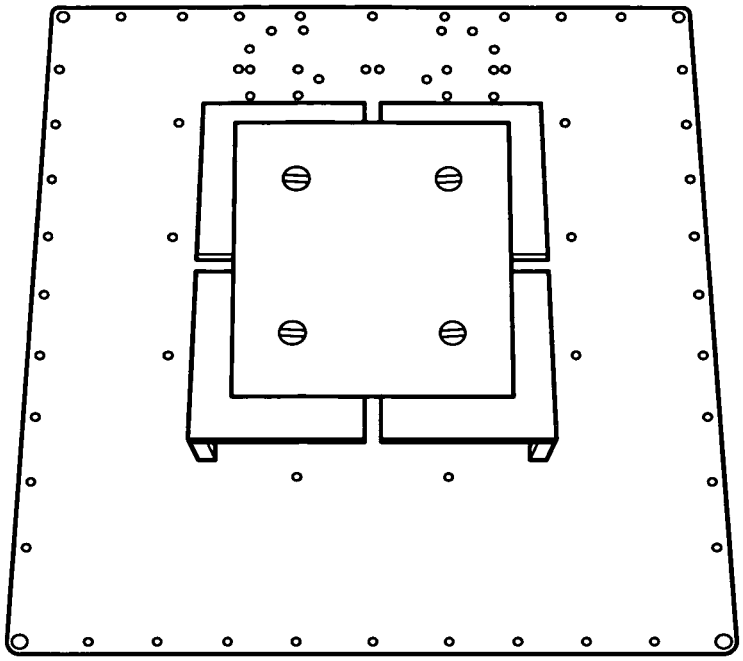
FIGS. 7 and 8 show a manufactured prototype of the antenna of FIGS. 5A to 5C.
Figure 8:
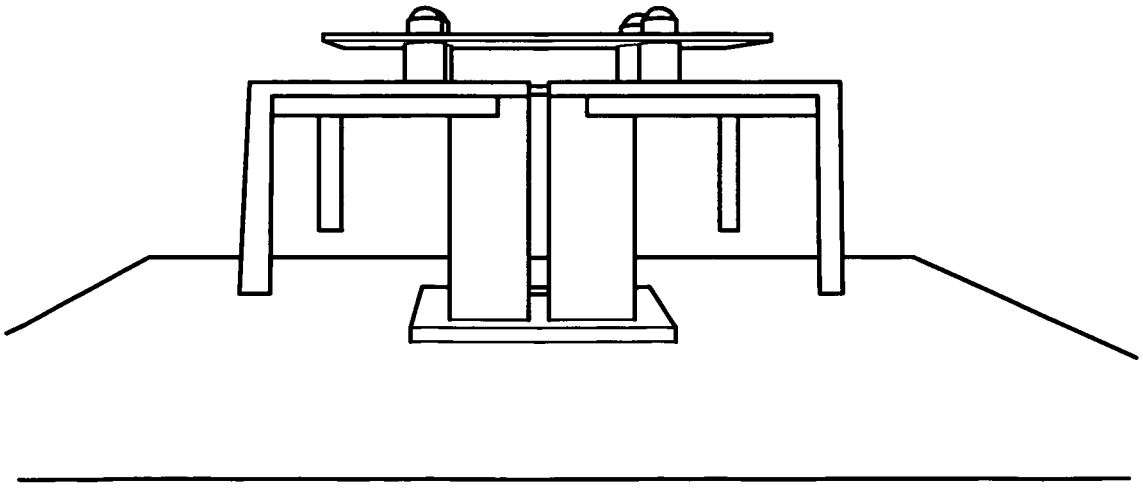

FIGS. 7 and 8 show a manufactured prototype of the antenna of FIGS. 5A to 5C.

Surrounding Wall

Figure 9:
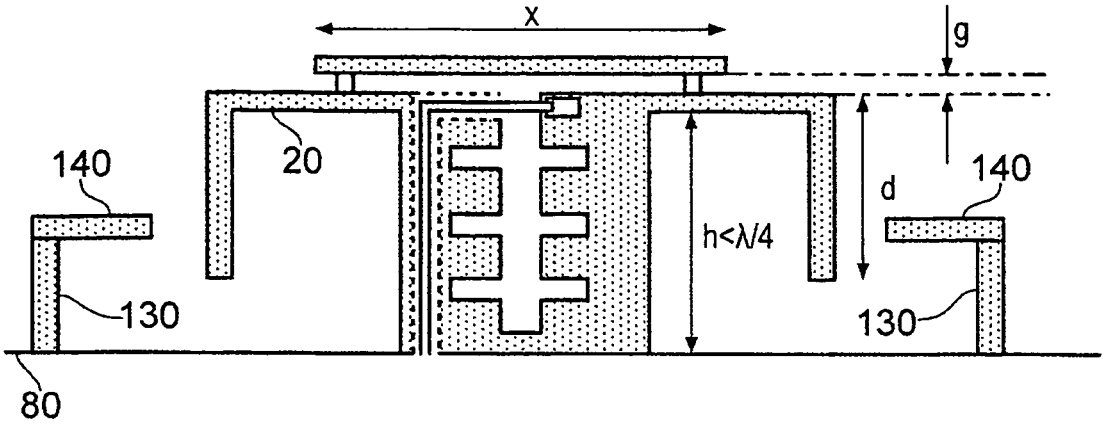
FIGS. 9 and 10 illustrate the provision of a surrounding wall structure according to one embodiment.
Figure 10:
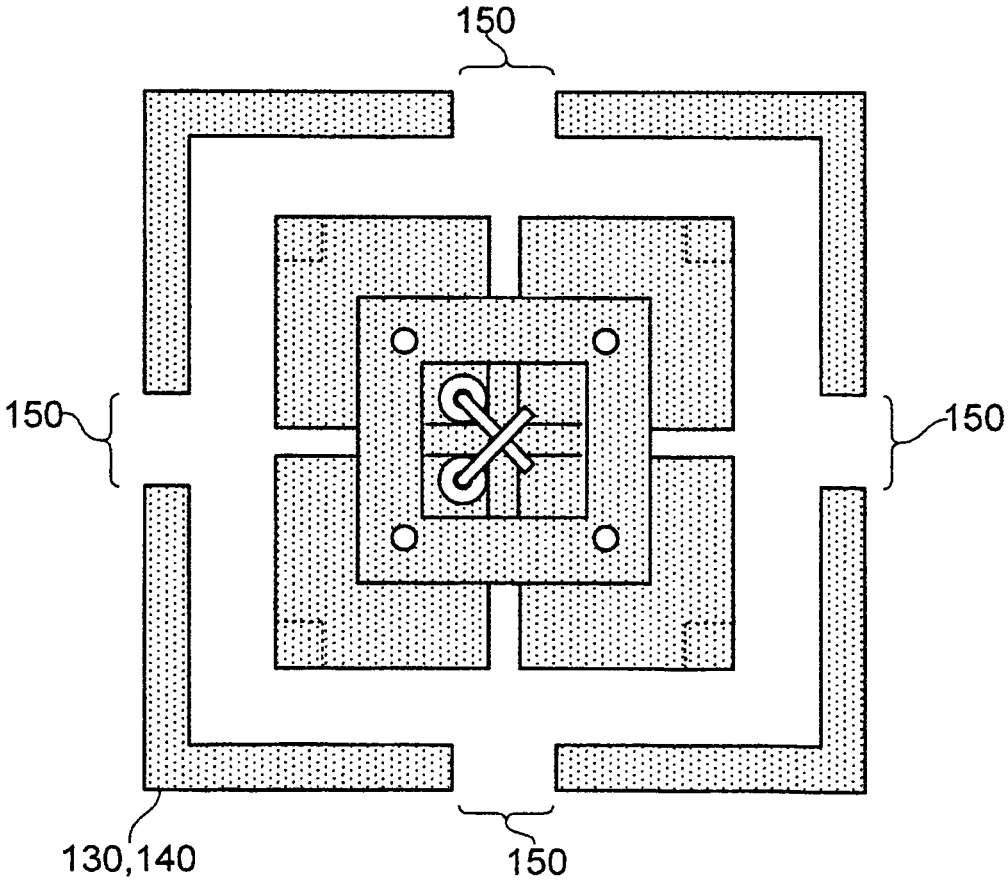

FIGS. 9 and 10 illustrate the provision of a surrounding wall structure according to one embodiment.

FIG. 9 is a side view of the antenna of FIG. 2, together with a surrounding wall composed of vertical and horizontal parts that are used for reducing the coupling between adjacent antennas when used to form compact antenna arrays.

FIG. 10 is a top view of the antenna of FIG. 9. The surrounding wall is composed of four separate parts (each of those surrounding a single dipole arm) so as not to significantly affect the cross-polarization performance of the antenna.

The surrounding wall structure may be placed around the antennas mentioned above. As already described, those antennas possess a smaller footprint and a smaller profile than that provided previously. The antennas are smaller than existing antennas but can still support multiple bands. Their compact size means that when being used in a compact antenna array (the array period of which is set to around a half wavelength), the performance of these antennas in terms of bandwidth, cross-polarization coupling and co-polarization coupling between adjacent elements, does not degrade significantly.

However, the performance of the antenna can be improved further when forming compact antenna arrays. This improvement is provided by the provision of a surrounding wall which further supresses the coupling between any adjacent antennas, without significantly affecting operating bandwidth or cross-coupling performance. The surrounding wall is conductive.

In this embodiment, a vertical part of 130 of the surrounding wall is mounted on the same PCB providing the ground plane 80 mentioned above. The horizontal part 140 of the wall is located on an upper surface of the vertical part 130. The height of the surrounding wall should remain low so as to not affect the radiating properties of the antenna which is mainly provided by the horizontal dipole arms 20. Accordingly, an adequate separation between the horizontal part 140 of the surrounding wall and the horizontal dipole arms 20 should be maintained. The height of the surrounding wall is typically set to less than half the distance between the ground plane 90 and the dipole arms 20.

The surrounding wall provides a decoupling mechanism between adjacent dipoles of compact antenna arrays because in such configurations the coupling between adjacent array elements occurs through a horizontal electric field that is supported between the neighbouring dipole arms. The presence of the horizontal part 140 of the wall causes some electrical lines to be coupled from the dipole arms 20 to the horizontal wall which reduces the strength of the electric field that couples directly to the adjacent radiator.

The main problem that the provision of such a surrounding wall causes is the degradation of the cross-polarization performance of each dipole. In order to alleviate this problem, the surrounding wall is formed by four parts (arranged as four corners) and is symmetrically located around the dipole arms of the antenna. This arrangement provides for a gap 150 between sections of the surrounding wall which prevents degradation of cross-polarization performance.

Figure 11:
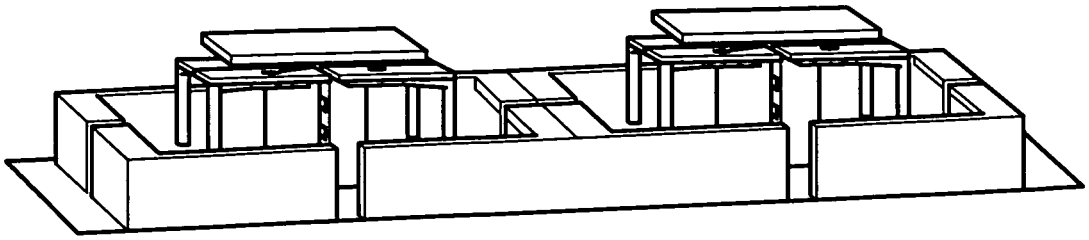
FIG. 11 shows a compact 2-element array optimized for operation in the AWS-1 band.

FIG. 11 shows a compact 2-element array optimized for operation in the AWS-1 band. The inter-element spacing is 90 mm (at 1.7 GHz this spacing corresponds to approximately a half wavelength).

Figure 12:
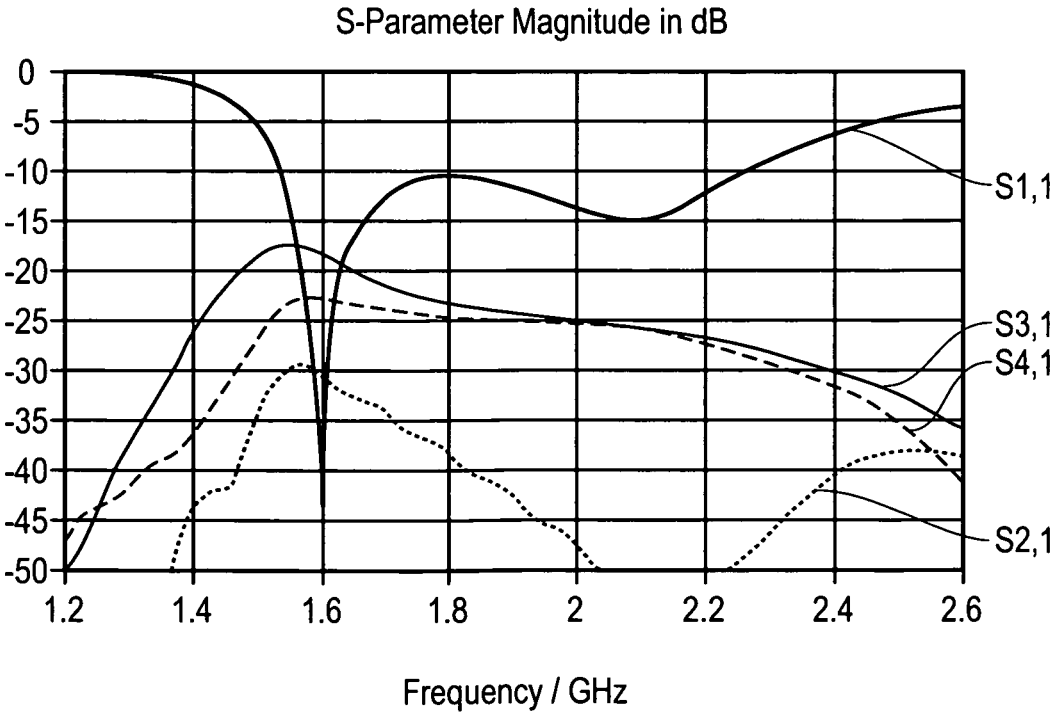
FIG. 12 shows the simulated S-parameters of the array configuration of FIG. 11.

FIG. 12 shows the simulated S-parameters of the array configuration of FIG. 11. At 1.7 GHz, the co-polarization coupling between the elements is below −20 dB. In the absence of the decoupling surrounding wall, the coupling would be 4-5 dB higher.

It will be appreciated that embodiments could be employed in compact antenna arrays designed to meet beam scanning requirements over large solid angles, such as those required in 4G cellular systems. Embodiments provide an antenna with a compact footprint, reduced coupling when used in compact arrays and a large patching bandwidth that enables simultaneous use over multiple frequency bands.

Embodiments mentioned above are low cost and may be fabricated using fully automated processes where 3D forms are made of metallised plastic and mounted on printed circuit boards. Embodiments provide for an antenna which can achieve a large range of footprint miniaturisation factors that may be required to form compact antenna arrays. The employed mechanisms to achieve miniaturisation also enable coupling reduction between elements of compact arrays. Embodiments provide an antenna that can be matched over large bandwidths (such as 40% fractional bandwidth). Therefore, embodiments provide an antenna that can be broadband, compact in size, light in weight, deliver high radiating efficiency values and can be fabricated using low cost materials.

A person of skill in the art would readily recognise that steps of various above-described methods can be performed by programmed computers. Herein, some embodiments are also intended to cover program storage devices, e.g., digital data storage media, which are machine or computer readable and encode machine-executable or computer-executable programs of instructions, wherein said instructions perform some or all of the steps of said above-described methods. The program storage devices may be, e.g., digital memories, magnetic storage media such as a magnetic disks and magnetic tapes, hard drives, or optically readable digital data storage media. The embodiments are also intended to cover computers programmed to perform said steps of the above-described methods.

The functions of the various elements shown in the Figures, including any functional blocks labelled as "processors" or "logic", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" or "logic" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non volatile storage. Other hardware, conventional and/or custom, may also be included. Similarly, any switches shown in the Figures are conceptual only. Their function may be carried out through the operation of program logic, through dedicated logic, through the interaction of program control and dedicated logic, or even manually, the particular technique being selectable by the implementer as more specifically understood from the context.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. A wideband antenna, comprising:

at least one dipole arm base to be received by a ground plane, said at least one dipole arm base supporting a first and second dipole arm each fed by a dipole arm feed, said dipole arm base being dimensioned to provide less than a quarter wavelength separation between said ground plane and said dipole arm, said dipole arm base having apertures to provide a quarter wavelength effective electrical length between said ground plane and said dipole arm feed.

2. The wideband antenna of claim 1, wherein said apertures are provided between said ground plane and said dipole arm feed.

3. The wideband antenna of claim 1, wherein said apertures are defined by slots extending into said dipole arm base.

4. The wideband antenna of claim 1, comprising an assembly of a plurality of adjacent dipole arm bases, each having said apertures positioned adjacently on an interior of said assembly.

5. The wideband antenna of claim 1, comprising:

a dipole having said first and second dipole arm each connected with a dipole finger, each dipole finger being orientated in a direction orthogonal to said dipole arm, each dipole arm and dipole finger together providing a quarter wavelength effective electrical length.

6. The wideband antenna of claim 5, wherein each dipole arm comprises a conductive flat plate and said dipole finger comprises an elongate conductive rod coupled towards an edge of said conductive flat plate.

7. The wideband antenna of claim 5, wherein each dipole arm extends parallel to said ground plane and said dipole finger is orientated to extend towards said ground plane.

8. The wideband antenna of claim 1, comprising an assembly of an adjacent plurality of said dipole arm bases having a conductive plate positioned parallel to and in a near-field generated by each dipole arm.

9. The wideband antenna of claim 8, wherein said conductive plate is symmetric.

10. The wideband antenna of claim 9, wherein said conductive plate defines a central aperture.

11. The wideband antenna of claim 1, comprising:

at least an adjacent pair of said wideband antennas spaced apart by a conductive wall located therebetween, said conductive wall comprising a first component upstanding from said ground plane and a second component extending orthogonally from said first component.

12. The wideband antenna assembly of claim 11, wherein said second component is orientated parallel with respect to said first and second dipole arm and said first component extends towards and is orientated orthogonally with respect to said first and second dipole arm.

13. The wideband antenna of claim 11, wherein said conductive wall extends around each wideband antenna and defines apertures between adjacent dipole arms of each wideband antenna.

14. A method, comprising:

assembling a wideband antenna as claimed in claim 1 on a printed circuit board.

15. The method of claim 14, wherein said assembling comprises assembling an assembly of an adjacent plurality of said dipole arm bases, each having said apertures positioned adjacently on an interior of said assembly.

* * * * *